US006499442B2

(12) United States Patent
Hollis

(10) Patent No.: US 6,499,442 B2
(45) Date of Patent: Dec. 31, 2002

(54) INTEGRAL WATER PUMP/ELECTRONIC ENGINE TEMPERATURE CONTROL VALVE

(76) Inventor: Thomas J. Hollis, 5 Roxbury Dr., Medford, NJ (US) 08055

( * ) Notice: Subject to any disclaimer, the term of this patent is extended or adjusted under 35 U.S.C. 154(b) by 0 days.

(21) Appl. No.: 10/022,087

(22) Filed: Dec. 18, 2001

(65) Prior Publication Data

US 2002/0073942 A1 Jun. 20, 2002

Related U.S. Application Data

(60) Provisional application No. 60/256,320, filed on Dec. 18, 2000.

(51) Int. Cl.[7] ..... F01P 5/10; F01P 7/14
(52) U.S. Cl. ..... 123/41.1; 123/41.44
(58) Field of Search ..... 123/41.1, 41.09, 123/41.44

(56) References Cited

U.S. PATENT DOCUMENTS 5,458,096 A 10/1995 Hollis ..... 123/41.2
5,503,118 A 4/1996 Hollis ..... 123/41.44
5,551,384 A 9/1996 Hollis ..... 123/142.5
5,724,931 A 3/1998 Hollis ..... 123/142.5
6,056,518 A 5/2000 Allen et al. ..... 417/355

*Primary Examiner*—Noah P. Kamen
(74) *Attorney, Agent, or Firm*—Drinker Biddle & Reath LLP

(57) ABSTRACT

A water pump assembly for controlling the flow of temperature control fluid in an internal combustion engine. The water pump assembly includes a housing with an inlet, an outlet and an electric motor assembly for causing fluid to flow from the inlet to the outlet. A housing is mounted to the inlet of the water pump and an outlet of a radiator. A valve member is located within the housing and reciprocatable between a first and second position. The valve member permits fluid flow from the radiator to the inlet in the first position and inhibits fluid flow in the second position. The valve member is positioned within the inlet of the water pump. A bypass inlet is formed in the inlet and channels a flow of fluid into the inlet. An electronic control system controls the actuation of the valve between the first and second position.

4 Claims, 4 Drawing Sheets

INTEGRAL WATER PUMP/ELECTRONIC ENGINE TEMPERATURE CONTROL VALVE

RELATED APPLICATIONS

The present application is related to and claims priority from U.S. Provisional Application Ser. No. 60/256,320, filed Dec. 18, 2000, which is incorporated herein by reference in its entirety.

FIELD OF THE INVENTION

This invention relates to a water pump for controlling the heating and cooling of an internal combustion gasoline or diesel engine by controlling the flow of temperature control fluid through the engine.

BACKGROUND OF THE INVENTION

Page 169 of the *Goodheart-Willcox automotive encyclopedia*, The Goodheart-Willcox Company, Inc., South Holland, Ill., 1995 describes that as fuel is burned in an internal combustion engine, about one-third of the heat energy in the fuel is converted to power. Another third goes out the exhaust pipe unused, and the remaining third must be handled by a cooling system. This third is often underestimated and even less understood.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such circumstances since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, conventional coolant systems employ a thermostat. The thermostat operates as a one-way valve, blocking or allowing flow to the radiator. Most prior art coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine parts are cold so as to allow the engine to reach an optimum hot operating temperature. Since one or both of the intake manifold and heater need hot coolant in cold ambient air temperatures and/or during engine start-up, and since these components are normally situated along the same flow circuit as the engine block, it is not practical to completely shut off the coolant flow through the engine block.

Numerous proposals have been set forth in the prior art to more carefully tailor the coolant system to the needs of the vehicle and to improve upon the relatively inflexible prior art thermostats. The inventor of the present invention has patented several such improvements. In particular, U.S. Pat. Nos. 5,503,118, 5,458,096, and 5,724,931 disclose improvements to conventional cooling systems. These prior art references are incorporated herein in their entirety by reference.

A water pump is used in conventional engines to circulate coolant through the engine. Prior art water pumps are limited in functionality in that they simply act as a mechanism for transmitting the flow of fluid. These prior art water pumps lack the ability to selectively distribute temperature control fluid to various parts of an internal combustion engine in a controlled manner so as to ensure the engine is operating at an optimal temperature level. An example of one type of conventional prior art water pump is described in U.S. Pat. No. 6,056,518.

Accordingly, a need therefore exists for a water pump that is capable of optimally controlling the flow of a fluid in a cooling system and is compatible with the current engine arrangement.

SUMMARY OF THE INVENTION

An improved water pump is disclosed for an internal combustion engine. The engine includes an engine block, an air-intake manifold, at least one cylinder head, and an exhaust manifold. The water pump operates in conjunction with a valve for controlling the flow of temperature control fluid through the engine in response to commanded signals in order to maintain the engine (and/or engine oil) at or near a desired temperature for maximum efficiency.

The water pump includes a housing with an inlet, a bypass inlet and an outlet. The water pump disperses temperature control fluid to the engine block through the outlet and receives temperature control fluid through the inlet and bypass inlet. Within the housing is an electric motor assembly for causing the water to flow from the inlet to the outlet. An electronic engine temperature control valve is mounted to the inlet and has a first and second position. When the control valve is in the first position, flow is permitted to travel from the inlet to the electric motor assembly. When the control valve is in the second position, flow is inhibited from traveling from the inlet to the electric motor assembly.

The control valve is adapted to receive signals from an electronic control system for controlling the actuation of the valve between the first and second positions. The bypass inlet is adapted to receive flow of temperature control fluid from a bypass passage and channel the flow to the electric motor assembly. The control valve is adapted to substantially close the bypass inlet when in the first position so as to inhibit flow from the bypass passage to the electric motor assembly.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with one or more preferred embodiments, it will be understood that it is not intended to limit the invention to any particular embodiment. On the contrary, it is intended to cover all alternatives, modifications, and equivalents as may be included within the spirit and scope of the invention as defined by the appended claims.

Certain terminology is used herein for convenience only and is not to be taken as a limitation on the invention. Particularly, words such as "upper," "lower," "left," "right," "horizontal," "vertical," "upward," and "downward" merely describe the configuration shown in the figures. The terms "inhibiting" and "restricting" are intended to cover both partial and full prevention of fluid flow.

For the sake of brevity, when discussing the flow of temperature control fluid in the engine, it should be understood that the fluid flows through water jackets formed within the engine. For example, when discussing the flow of temperature control fluid through an engine block, it should be understood that the fluid is flowing through a water jacket of the engine block.

Figure 1:
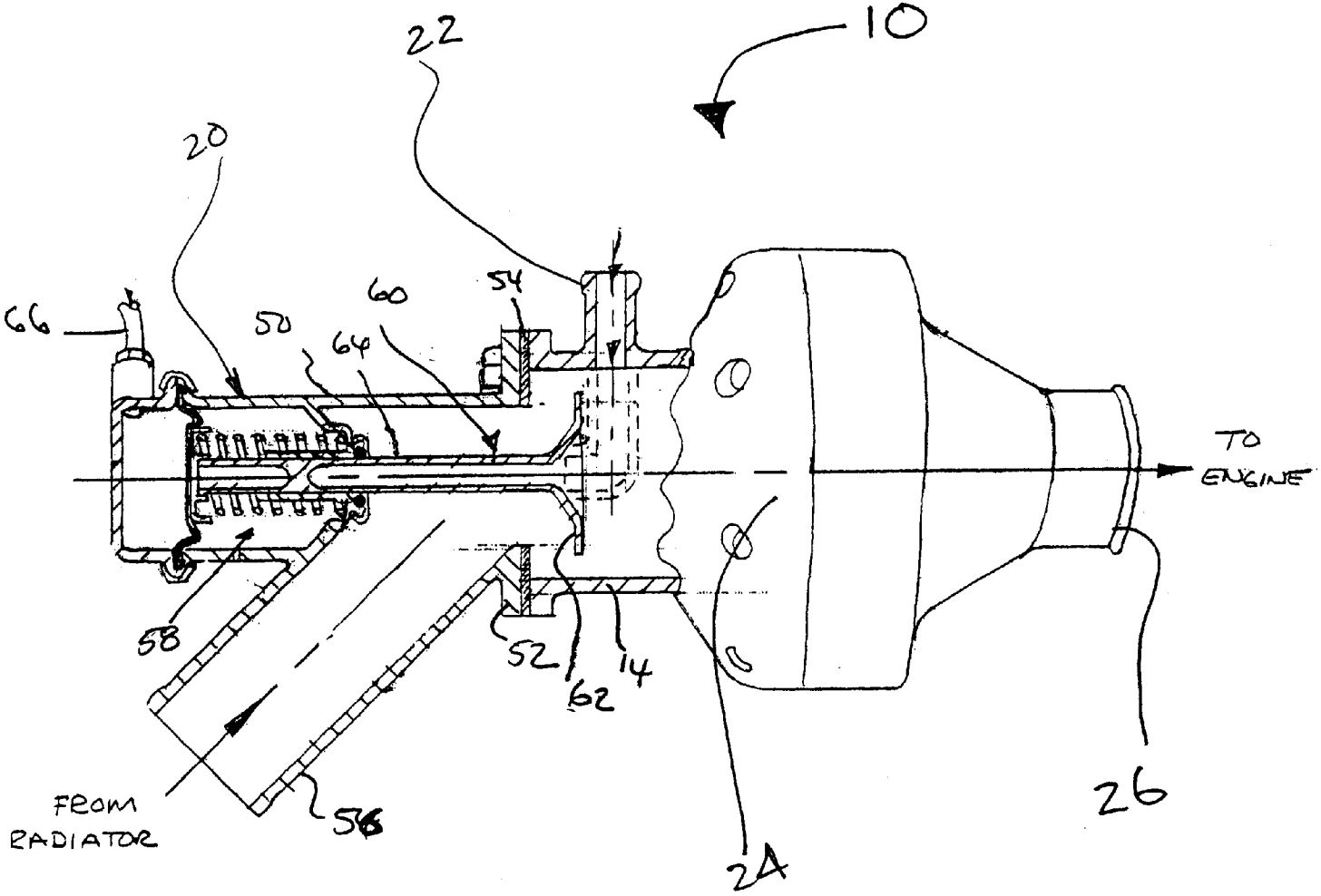
FIG. 1 is schematic side view of a water pump/valve combination in accordance with the present invention.

FIG. 1 illustrates a water pump in accordance with the present invention and is generally designated with numeral 10. The water pump 10 is an electronic water pump which is powered by the vehicle's battery. One suitable water pump is sold by Engineered Machined Products, Inc. That water pump is described in detail in U.S. Pat. No. 6,056,518. The water pump includes an inlet 14, a bypass inlet 22, an electric motor assembly 24, and an outlet 26.

Figure 2:
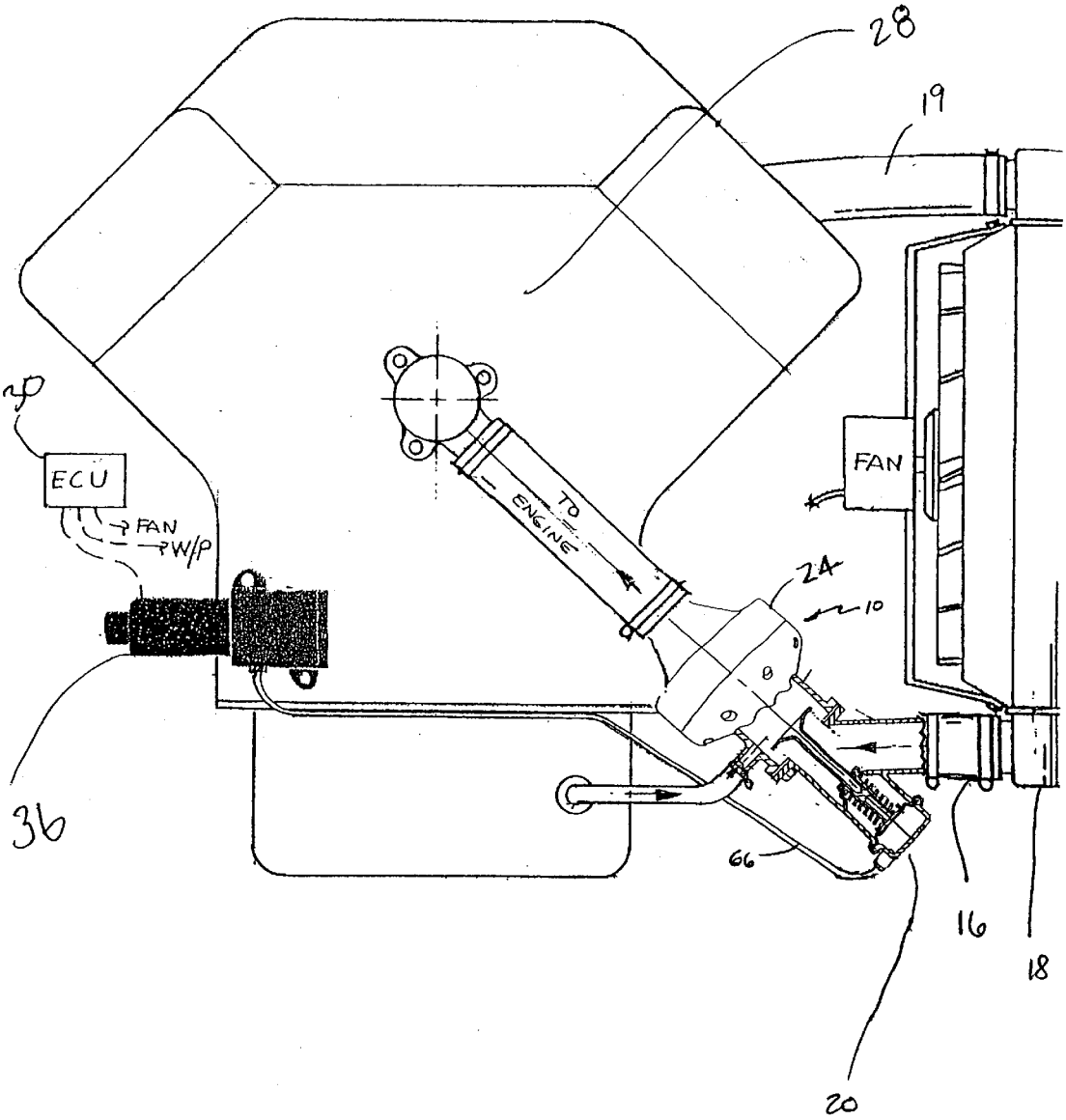
FIG. 2 is an enlarged view of an internal combustion engine in accordance with the present invention illustrating the location of the water pump/valve combination between the radiator outlet and the engine block.

The inlet 14 is in fluid communication with an outlet 16 of a radiator 18 (see FIG. 2) of a internal combustion engine. Located at the inlet 14 of the water pump 10 (between the outlet 16 of the radiator and the inlet 14 of the water pump 10) is an electronic engine temperature control valve 20 which controls flow of temperature control fluid into the electric water pump 10 as will be described in more detail below.

The outlet 26 of the water pump 10 is attached to the engine block 28 (see FIG. 2) in a conventional manner. Thus, temperature control fluid passing from the inlet 14 of the water pump through the electric motor assembly 24 and out through the outlet 26 is directed into the engine block for cooling the engine in a conventional manner.

The electronic engine temperature control valve 20 includes a housing 50 with and outlet flange 52 attached to mating flange on the inlet 14 of the water pump through a conventional attachment. A bolted attachment is shown in the FIG. 1. A seal or gasket 54 is preferably disposed between the flanges to prevent leakage. The control valve 20 also includes an inlet end 56 which attaches to the outlet 16 of the radiator. A valve assembly 58 is mounted within the housing 50 and controls flow of temperature control fluid between the valve inlet 56 and the water pump inlet 14. The valve assembly 58 preferably includes a reciprocatable valve member 60 with a valve head 62 mounted on a valve stem or shaft 64. The valve head 62 is preferably located within the inlet 14 of the water pump 10. Reciprocation of the valve shaft 64 moves the valve head toward and away from the valve outlet 52.

In the illustrated embodiment the valve is an hydraulic valve. As such pressurized hydraulic fluid is channeled along a fluid inlet line 66 to the valve for controlling reciprocation of the valve member. A detailed description of the electronic engine temperature control valve 20 is provided in U.S. Pat. No. 5,458,096, the specification of which is hereby incorporated by reference. Other types of valves may be used in the present invention.

A flow valve solenoid 36 preferably controls flow of pressurized oil along the fluid inlet line 66. The solenoid is described in detail in pending provisional application Ser. No. 60/186,120, filed Mar. 1, 2000 and entitled "Three-way Solenoid Valve for Actuating Flow Control Valves in a Temperature Control System," which is incorporated herein by reference in its entirety. A hydraulic solenoid injector system 36 is also described in detail in U.S. Pat. No. 5,724,931. which is also incorporated herein by reference in its entirety. The solenoid receives commands from an engine control unit, digital controller, signal processor or similar type of controller for providing control signals. For the sake of brevity, the controller will be referred to herein as the ECU 30.

The control valve 20 is actuatable between first and second positions. In FIGS. 1–4 the control valve 20 is shown in its first position. When the control valve 20 is in its first position the water pump operates to circulate temperature control fluid from the radiator through the inlet 14 and into the engine block. When the control valve 20 is in its second position, the valve head 62 seats against the gasket 62 or valve outlet 52 for inhibiting the passage of temperature control fluid from the radiator into the water pump 10.

As discussed above, the inlet 14 preferably includes a bypass inlet 22 which provides a flow of temperature control fluid into the electric motor assembly 24. The bypass inlet may be attached directly to the cylinder head manifold (immediately prior to the attachment of the radiator inlet 19, or may be attached to a heat exchanger mounted in the oil pan for heating the oil.

As shown, the flow into the water pump is not obstructed whether the control valve 20 is in either of its first or second positions. It is contemplated that the larger flow diameter of the valve inlet 56 than the bypass inlet 22 will guarantee that the primary flow into the water pump 10 will be from the radiator when the control valve 20 is in its first position.

In one embodiment of the invention, the bypass inlet 22 extends into the inlet 14 as shown in dashed lines. The head 62 of the valve member 60 engages with or otherwise inhibits flow through the bypass inlet 22 when the control valve 20 is in its first position. Thus, substantially all of the temperature control fluid will flow into the water pump 10 from the radiator 18.

The water pump 10 has two modes of operation corresponding to the two positions of the control valve. In the first mode of operation, the water pump channels temperature control fluid from the radiator to the engine to control the engine during normal or warm engine operation (i.e., after engine start-up.) In the second mode of operation, the engine is typically cold (i.e., during start-up.) As such, it is desirable in use the temperature control fluid to assist in heating the engine being heating the engine oil. In this mode, the heat from the hotter parts of the engine transferred to the colder areas, such as the engine oil. In the second mode, the control valve inhibits flow of from the radiator thereby causing the temperature control fluid to be continually recirculated through the engine block without being cooled by the radiator.

The ECU 30 controls the actuation of the valve 20 based on predetermined values. The operation of the ECU 30 is described in detail in U.S. Pat. Nos. 5,503,118 and 5,724,931, which are incorporated herein by reference in their entirety. The ECU 30 determines when and for how long the valve 20 should operate in a particular position.

Figure 3:
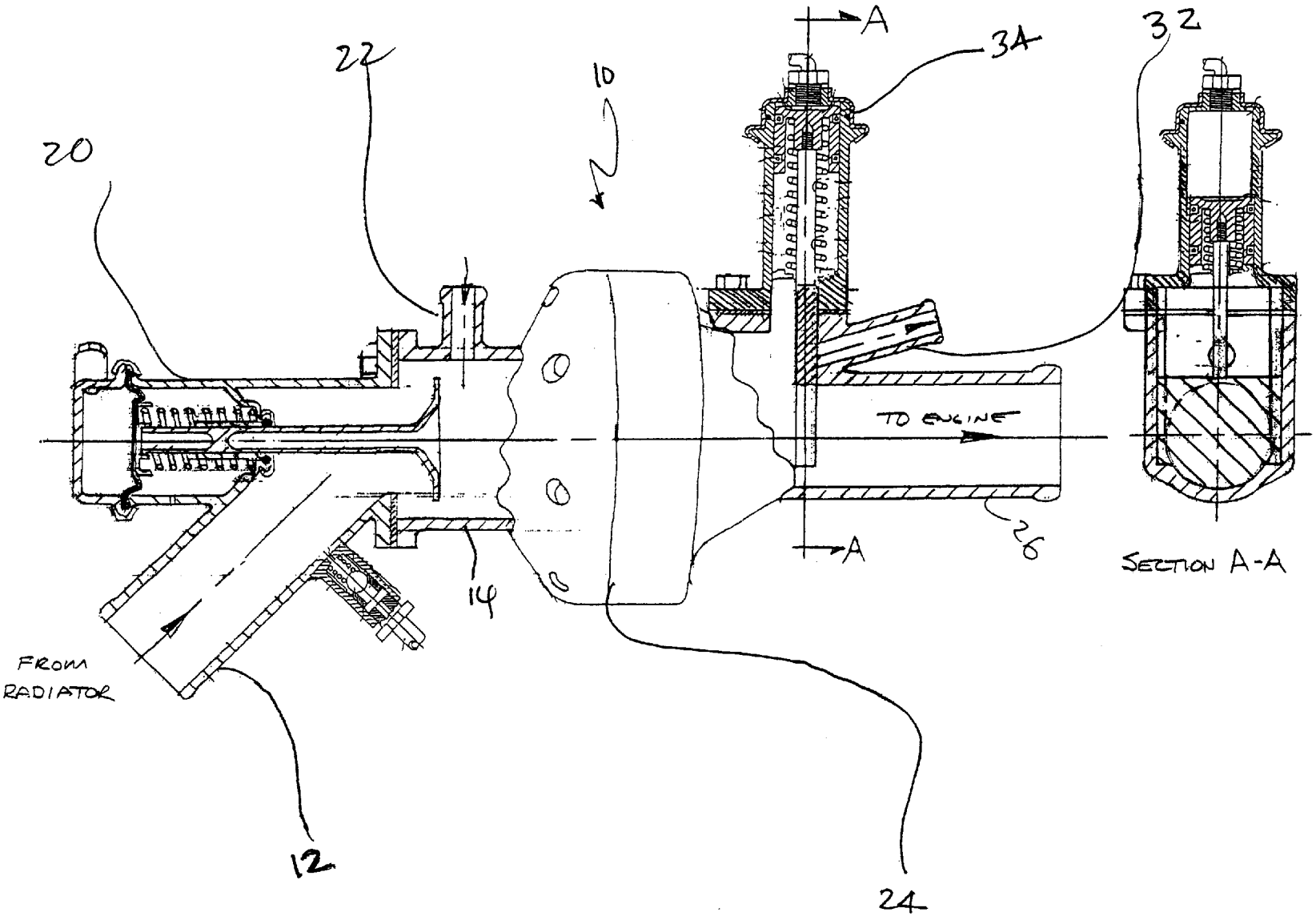
FIG. 3 is a schematic side view of an alternate embodiment of the water pump of the present invention.
Figure 4:
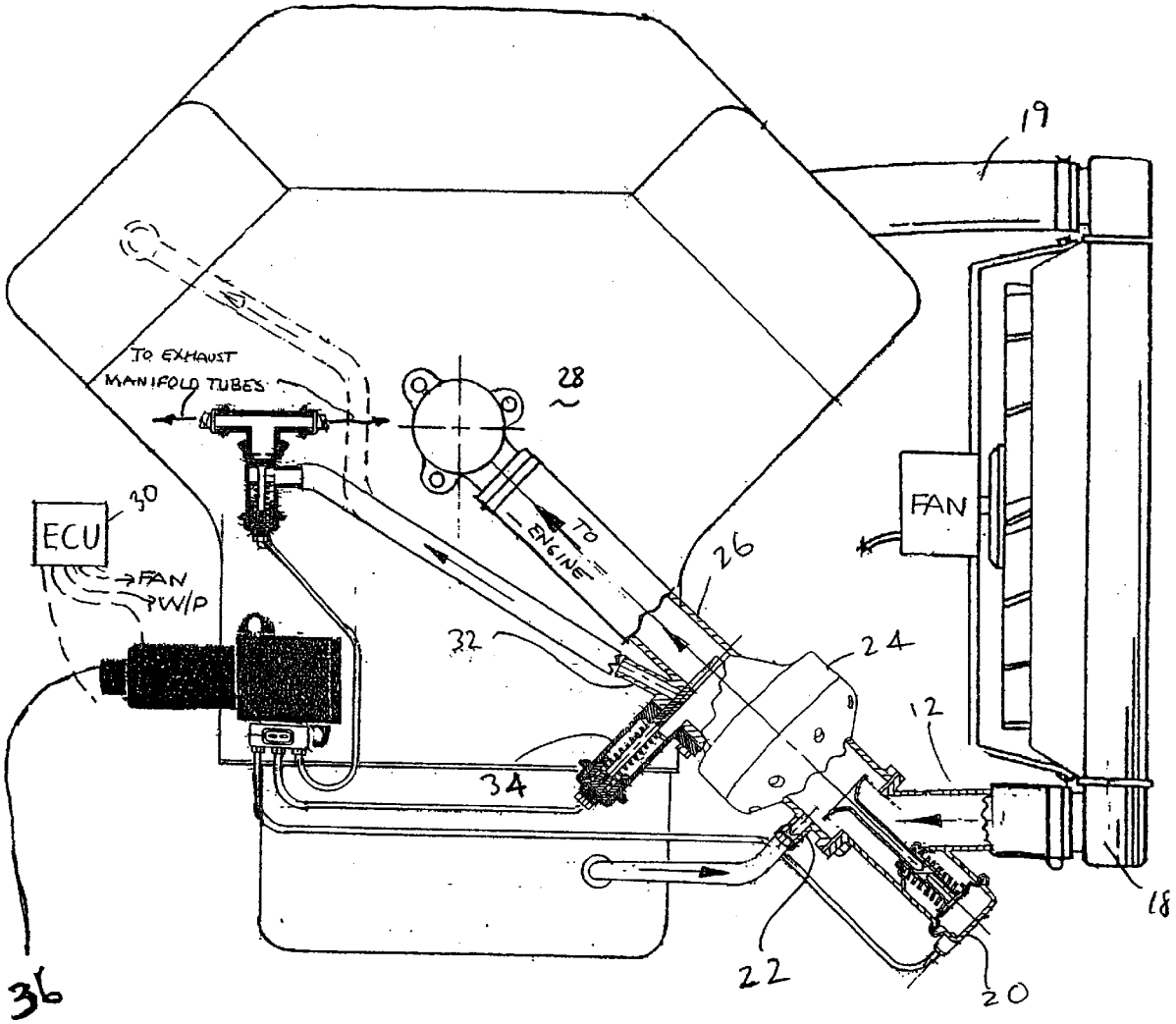
FIG. 4 is an enlarged view of an internal combustion engine in accordance with the present invention illustrating the location of the water pump of FIG. 3 between the radiator outlet and the engine block.

In an alternate embodiment of the invention shown in FIGS. 3 and 4, the improved water pump/valve combination 10, 20 includes a second flow control valve located on the outlet 26 side of the water pump 10. In this embodiment, the water pump 10 includes a block bypass outlet 32 and a block bypass gate valve 34 so as to facilitate a third mode of operation. The block bypass outlet 32 enables the water pump 10 to channel temperature control fluid directly to sources of heat within the engine such as to an exhaust manifold 38 or a cylinder head manifold (shown in dashed lines in FIG. 4).

The gate valve 34 has a first position and a second position. The first position enables temperature control fluid to flow through the block bypass outlet 32 and limits the amount of fluid from flowing to the engine block 28. The fluid flowing through the block bypass outlet 32 is heated and returned to the pump 10 via the bypass inlet 22. When the gate valve 34 is in its first position, the water pump 10 is in its third or heating mode and the control valve 20 will be in its second position so as to ensure that temperature control fluid is not subjected to the cooling effect of the radiator. A suitable gate valve for use in the present invention is discussed in more detail in U.S. Pat. No. 5,503,118.

The third mode of operation is a heating mode where internal sources of heat produced in certain areas of the combustion engine are utilized to warm-up other areas of the engine (such as the engine oil or the engine block.) The transfer of heat from the internal heat sources to another part of the engine is described in detail in U.S. Pat. Nos. 5,503,118, 5,551,384 and 5,724,931, which are each incorporated herein by reference in their entirety. In the second position of the gate valve 34, flow along the block by-pass is closed off. As such, the water pump 10 circulates temperature control fluid directly into the engine block 28.

The present invention provides a novel electric water pump/valve combination for controlling flow of temperature control fluid in an engine. While the present invention has described the ability to control the valve using an electronic control system, it is also contemplated that the ECU 30 could be used to control operation of the electric motor assembly 24 of the water pump. As such, the circulation of the water pump can be controlled so as to control the flow of the temperature control fluid directly through the engine block.

Accordingly, although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A water pump assembly for controlling the flow of temperature control fluid in an internal combustion engine, the engine including an engine block, an air-intake manifold, at least one cylinder head, and an exhaust manifold, the water pump being disposed between the engine block and an outlet hose of a radiator and adapted to receive flow of temperature control fluid from the radiator, the water pump assembly comprising:

a housing with an inlet and outlet;

an electric motor assembly for causing fluid flow from the inlet to the outlet;

an electronic engine temperature control valve including a housing mounted to the inlet of the water pump and the outlet of the radiator, the valve having a valve member reciprocatable between a first and second position, the valve member adapted to permit flow from temperature control fluid from the radiator to the inlet of the water pump in the first position and inhibiting flow in the second position, the valve member being positioned within the inlet of the water pump and adapted to close off flow of temperature control fluid from the radiator to the inlet of the water pump;

a bypass inlet formed in the inlet of the water pump and adapted to channel a flow of temperature control fluid into the inlet of the water pump; and an electronic control system adapted to control the supply of pressurized hydraulic fluid to the valve for controlling actuation of the valve between the first and second position.

2. A water pump assembly according to claim 1 further comprising a second control valve mounted to the outlet of the housing, and a block bypass outlet formed in the outlet downstream from the second valve, the second valve controlling flow of temperature control fluid along the outlet and the block bypass outlet, the second valve having a first position wherein flow of temperature control fluid is permitted along the outlet and inhibited along the block bypass outlet, and a second position wherein flow of temperature control fluid is permitted along the block bypass outlet and inhibited along the outlet, the block bypass outlet adapted to channel temperature control fluid toward a source of heat.

3. A water pump assembly according to claim 2 wherein the source of heat is the at least one cylinder head.

4. A water pump assembly according to claim 2 wherein the source of heat is the exhaust manifold.

* * * * *